United States Patent [19]

Kanigan

[11] 4,136,498

[45] Jan. 30, 1979

[54] BLOCK OR BRICK LAYING GUIDE REINFORCING MODULE

[76] Inventor: Cecil Kanigan, 1830-6th Ave., North, Regina, Canada

[21] Appl. No.: 857,818

[22] Filed: Dec. 5, 1977

[51] Int. Cl.[2] ..... E04C 2/04; E04C 1/10

[52] U.S. Cl. ..... 52/604; 52/585; 52/438; 52/442

[58] Field of Search ..... 52/105, 438, 442, 604, 52/712, 413, 412, 562, 603, 300, 585, 566, 564, 677, 695, 693, 442, 438

[56] References Cited

U.S. PATENT DOCUMENTS

| | | | |
|---|---|---|---|
| 641,067 | 1/1900 | Blazo | 52/438 |
| 1,785,067 | 12/1930 | Bemis | 52/300 |
| 2,423,682 | 7/1947 | Castle | 52/634 |
| 3,374,589 | 3/1968 | Neal | 52/442 |

FOREIGN PATENT DOCUMENTS

| | | | |
|---|---|---|---|
| 603096 | 6/1948 | United Kingdom | 52/585 |
| 625552 | 6/1949 | United Kingdom | 52/585 |

*Primary Examiner*—James L. Ridgill, Jr.
*Attorney, Agent, or Firm*—Stanley G. Ade

[57] ABSTRACT

A plastic or metal web is provided with upper and lower projecting truncated conical members with a surrounding edge band having a thickness equal to the conventional mortar joint between brick or block courses. It is placed on the last laid course with the downwardly extending members frictionally engaging within the apertures in the bricks or blocks. Mortar or other adhesive may be used if desired and the next course is then laid engaging the upwardly projecting members. The spacing of the projecting members is such that the bricks or blocks are aligned spaced and reinforced thus facilitating laying of the bricks or blocks.

13 Claims, 4 Drawing Figures

BLOCK OR BRICK LAYING GUIDE REINFORCING MODULE

BACKGROUND OF THE INVENTION

This invention relates to new and useful improvements in brick or block laying, particularly the laying of bricks or blocks having vertical apertures formed therethrough.

Such bricks or blocks are normally laid upon the footing or the like either in staggered relationship or stacked relationship, with usually mortar joints or other adhesive joints therebetween and it is a relatively skilled job to lay such bricks or blocks in order to maintain the verticality of the finished wall, the vertical spacing between adjacent courses and the horizontal positioning of the bricks or blocks.

SUMMARY OF THE INVENTION

The present invention overcomes these disadvantages by providing a plastic or metal web module which can be engaged upon the last laid course of bricks or blocks and which will enable the next course to be laid with the desired spacing and verticality automatically provided for thus facilitating the brick or block laying function.

One aspect of the invention is to provide a block or brick laying guide and reinforcing module for vertically apertured blocks and bricks, comprising a web of material substantially rectangular when viewed in plan and a plurality of upwardly and downwardly projecting members extending from the opposing faces of said web and adapted to engage the vertical apertures of the associated blocks and bricks thereby centering adjacent courses, providing and maintaining horizontal positioning of said blocks and bricks and providing and maintaining the vertical spacing between courses.

Another aspect of the invention is to provide a device of the character herewithin described which can be used with or without mortar or adhesive between adjacent courses depending upon design parameters, Another aspect of the invention is to provide a device of the character herewithin described, which when used mortar between adjacent courses, acts as a reinforcing medium as well as acting to facilitate the laying of the bricks or blocks.

A still further aspect of the invention is to provide a device of the character herewithin described which is simple in construction, economical in manufacture and otherwise well suited to the purpose for which it is designed.

With the foregoing in view, and other advantages as will become apparent to those skilled in the art to which this invention relates as this specification proceeds, my invention consists essentially in the arrangement and construction of parts all as hereinafter more particularly described, reference being had to the accompanying drawings in which:

DESCRIPTION OF THE DRAWINGS

In the drawings like characters of reference indicate corresponding parts in the different figures.

DETAILED DESCRIPTION

Figures 1, 2, 3, 4:
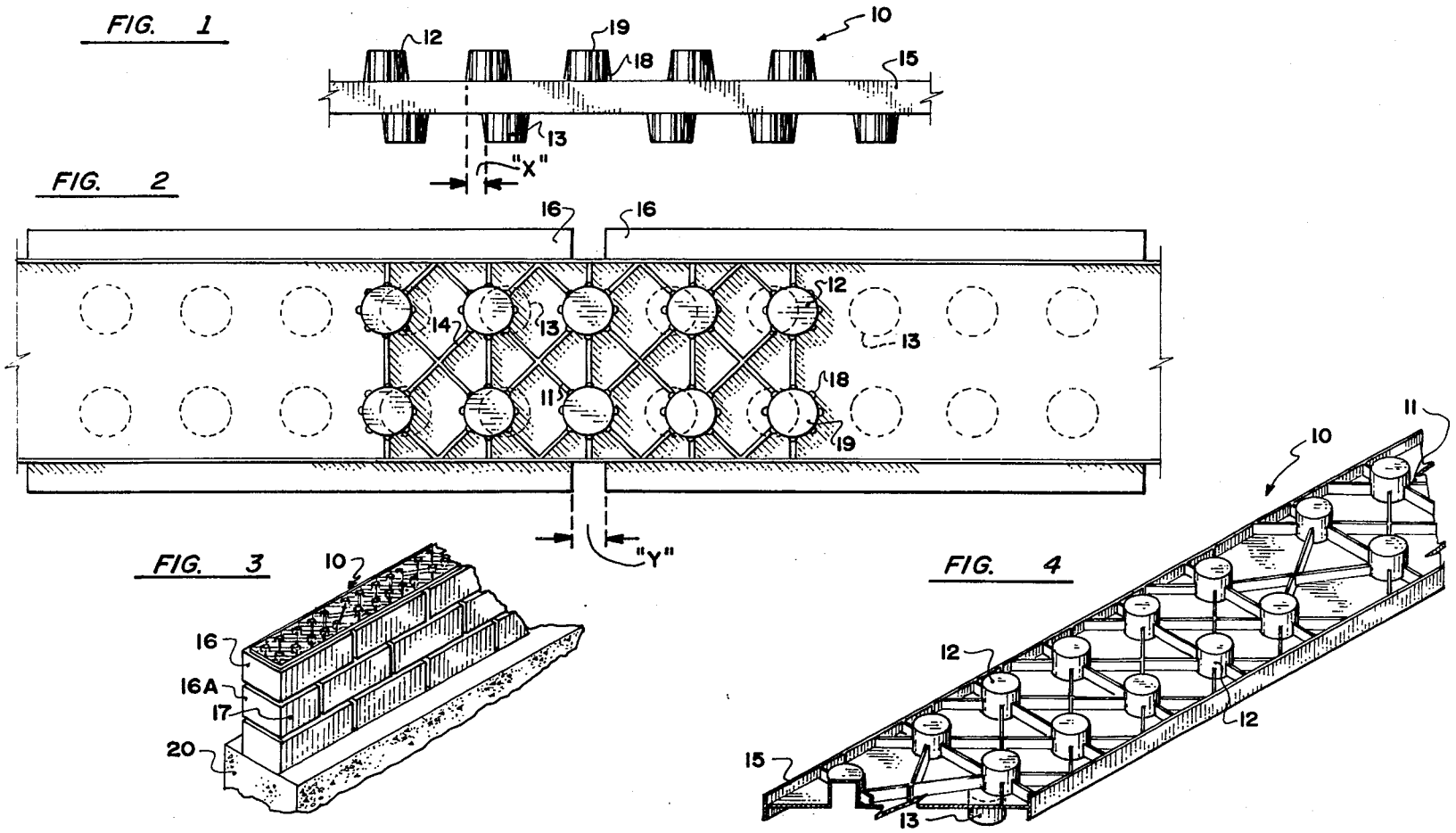
FIG. 1 is a side view of one embodiment of the module.
FIG. 2 is a top plan view of a brick course showing the module in position.
FIG. 3 is an isometric view of part of a wall with the guide or module on the upper course ready to receive the next course.
FIG. 4 is an isometric view of part of one of the guide modules.

Proceeding therefore to describe the invention in detail, reference character 10 illustrates the guide module which is preferably made from plastic but can be made from metal if desired.

It is of any convenient length and comprises a web 11 and a set of upwardly projecting members 12 together with a further set of downwardly projecting members 13.

In this embodiment, the web consists of diagonal vertically situated strips 14 extending between the upper and lower members 12 and 13 and being connected thereto thus positioning these members as clearly shown.

A perimetrical edge band 15 extends around the outer edges of the web structure and defines the elongated guide module and this edge band together with the depth of the webs 14, controls the vertical spacing between adjacent courses 16, 16A, etc., of a brick or block wall.

The width of the guide module is slightly less than the width of the brick or block 17 making up the wall and the members 12 and 13 are preferably hollow and cylindrical in configuration. They may be in the form of truncated cones or alternatively, may be provided with radially extending fins 18, the thickness of which increases from the outer sides 19 of the members towards the web 11.

Either construction facilitates the frictional engagement of the members within the conventional apertures normally provided in bricks and blocks.

It will also be observed that the horizontal spacing of the upper and lower members 12 and 13 (as shown by "X" in FIG. 1) is such that they are staggered relative to one another by an amount equal to approximately half the desired vertical spacing between adjacent bricks or blocks 16 (as shown by "Y" in FIG. 2) thus controlling this distance accurately. The frictional engagement of the members 12 and 13 with the blocks ensures verticality of the structure assuming that the footings 20 are true, the web thickness and the thickness of the edge band 15 controls the vertical spacing between adjacent courses and the relative positioning of the upper and lower members 12 and 13 controls the vertical spacing between adjacent bricks or blocks.

In operation, the first course is laid upon the footing whereupon a strip of the guide module is engaged upon the upper surface of the course of bricks and pressed downwardly so that the lower members 13 engage within the brick apertures. The next course is then laid so that it becomes automatically positioned relative to the previously laid course.

If desired, mortar or other adhesive may be placed between the module and the brick courses whereupon the module acts as a reinforcement between adjacent courses. Also the surrounding edge band 15 and the web 11 controls the thickness of the mortar and maintains the desired thickness between adjacent courses.

Although the guide module is shown for use with conventional bricks 16, nevertheless the positioning and size of the members 12 and 13 may be varied to suit the apertures in any block or brick desired.

The guide module 10 is preferably manufactured from synthetic plastic but of course can be stamped from sheet metal if desired.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. A block or brick laying guide and reinforcing module for vertically apertured blocks and bricks, comprising a web of material substantially rectangular when viewed in plan and a plurality of upwardly and downwardly projecting members extending from the opposing faces of said web and adapted to engage the vertical apertures of the associated blocks and bricks thereby centering adjacent courses, providing and maintaining horizontal positioning of said blocks and bricks and providing and maintaining the vertical spacing between courses, and a plurality of radially extending fins formed on the exterior surface of said member.

2. The invention according to claim 1 in which upper and lower members are spaced horizontally from one another approximately half the distance of the desired spacing between adjacent side by side blocks or bricks.

3. The invention according to claim 1 which includes a surrounding perimetrical edge band formed on said web thereby defining the confines of the module.

4. The invention according to claim 3 in which upper and lower members are spaced horizontally from one another approximately half the distance of the desired spacing between adjacent side by side blocks or bricks.

5. The invention according to claim 1 in which said members take the form of hollow frustro conical members, said web being perforated between members.

6. The invention according to claim 5 in which upper and lower members are spaced horizontally from one another approximately half the distance of the desired spacing between adjacent side by side blocks or bricks.

7. The invention according to claim 5 which includes a surrounding perimetrical edge band formed on said web thereby defining the confines of the module.

8. The invention according to claim 7 in which upper and lower members are spaced horizontally from one another approximately half the distance of the desired spacing between adjacent side by side blocks or bricks.

9. A block or brick laying guide and reinforcing module for vertically apertured blocks and bricks, comprising a web of material substantially rectangular when viewed in plan and a plurality of upwardly and downwardly projecting members extending from the opposing faces of said web and adapted to engage the vertical apertures of the associated blocks and bricks thereby centering adjacent courses, providing and maintaining horizontal positioning of said blocks and bricks and providing and maintaining the vertical spacing between courses, said upper and lower members being spaced horizontally from one another approximately half the distance of the desired spacing between adjacent side by side blocks or bricks.

10. The invention according to claim 9 in which said members take the form of hollow frustro conical members, said web being perforated between members.

11. The invention according to claim 9 which includes a surrounding perimetrical edge band formed on said web thereby defining the confines of the module.

12. The invention according to claim 9 which includes a plurality of radially extending fins formed on the exterior surface of said members.

13. The invention according to claim 12 in which upper and lower members are spaced horizontally from one another approximately half the distance of the desired spacing between adjacent side by side blocks or bricks.

* * * * *